United States Patent [19]

Hamberger et al.

[11] 4,010,681

[45] Mar. 8, 1977

[54] CYLINDRICAL ARTICLE PRINTER

[75] Inventors: Hermann Hamberger, Rielasingen; Erwin Ulrich, Talheim, both of Germany

[73] Assignee: Gesellschaft fur Elektro-Feintechnik mbH & Co. KG, Germany

[22] Filed: Jan. 29, 1975

[21] Appl. No.: 545,180

[30] Foreign Application Priority Data

Feb. 8, 1974 Germany ..... 2405944

[52] U.S. Cl. ..... 101/38 R; 101/5

[51] Int. Cl.[2] ..... B41F 17/08

[58] Field of Search ..... 101/7, 38 A, 38 R, 39, 101/40, 5, 22, 28, 9, DIG. 4, 36, 10, 27, 42; 197/6

[56] References Cited

UNITED STATES PATENTS

| | | | |
|---|---|---|---|
| 1,386,812 | 8/1921 | Thompson | 101/38 R |
| 2,170,610 | 8/1939 | Schutz | 101/38 R X |
| 2,596,176 | 5/1952 | Scherer | 101/38 R |
| 2,602,397 | 7/1952 | Last | 101/7 X |
| 2,740,217 | 4/1956 | DeLiso | 101/DIG. 4 |
| 2,923,232 | 2/1960 | Worth | 101/7 X |
| 3,018,188 | 1/1962 | Nicoll | 101/DIG. 4 |
| 3,019,724 | 2/1962 | Hoffmann | 101/7 |
| 3,260,194 | 7/1966 | Karlyn | 101/38 R |
| 3,411,438 | 11/1968 | Reader et al. | 101/DIG. 4 |
| 3,621,776 | 11/1971 | Sauke | 101/38 R |
| 3,640,213 | 2/1972 | Schwartzbach | 101/38 R |
| 3,659,523 | 5/1972 | Olsen | 101/38 R |

*Primary Examiner*—Edgar S. Burr
*Assistant Examiner*—Paul J. Hirsch
*Attorney, Agent, or Firm*—McGlew and Tuttle

[57] ABSTRACT

A printing device for printing cylindrical objects, such as wheels, comprises a printing stereotype having a cylindrically arcuate printing surface and which is rotatably mounted at a fixed position alongside a pivotal workpiece mounting support. A workpiece holder is rotatably mounted on the support and it may be moved toward and away from the printing stereotype in order to move the workpiece holder in directions to make it possible to engage the printing stereotype on the surface of a workpiece and to thereafter move it out of engagement therewith. The construction includes a carrier ribbon containing thermoplastic ink which is trained to run between the workpiece holder and the printing stereotype in order to effect transfer of the printed image to the article to be printed. A positive gear drive transmission is connected to the printing stereotype and to the workpiece support and effects rotation of the stereotype and the associated arcuate printing surface and rotation of the workpiece support in a fixed angular velocity speed ratio.

1 Claim, 3 Drawing Figures

CYLINDRICAL ARTICLE PRINTER

FIELD AND BACKGROUND OF THE INVENTION

This invention relates in general to the construction of printing devices and, in particular, to a new and useful printing device for printing cylindrical objects which includes a rotatable workpiece support and rotatable printing stereotype which are interengaged and which are driven by a transmission to effect a fixed angular velocity speed ration therebetween.

DESCRIPTION OF THE PRIOR ART

The present invention deals particularly with devices for printing number wheels or similar devices in a hot impression process in which an electrically heated stereotype is provided with a relief letter or impression surface and is engaged with the workpiece cylindrical object in order to transfer and print an impression thereon. In the known hot impression devices of this kind which are employed particularly for imprinting on plastic wheels, flat straight stereotype printers are employed on which the wheel cylinder to be impressed is rolled under pressure in a straight line motion over the printing surface. Due to the pressure and heat of the stereotype, ink is transferred in a pattern corresponding to the letters of the stereotype from a carrier strip coated with a thermoplastic ink to the wheel object being printed. In such a case, the foil strip is in direct contact with the stereotype, while the ink layer is applied to the side of the strip which faces the wheel being printed. In such devices, a straight line and a rolling motion is performed during the impression. The workpiece holder receiving the body of the number wheel is kinematically connected through a gear to a toothed rack so that during the linear motion of the impression stereotype relative to the wheel to be imprinted, any slip is prevented.

A constant problem appears in such rolling methods, namely, the problem of compensating for possible diameter tolerances so as to distribute the numbers uniformly over the circumference of the wheel to be imprinted. All numerals are to be spaced at equal distance. In the manufacture of the stereotypes, it is difficult to adhere to fixed dimensional tolerances. This is particularly true while printing graduations with narrow divisions and dimensional deviations become strikingly evident because, in such cases, even a relatively small disparity between the first and the last division is easily recognizable. Temperature differences which have a very unequal effect on the stereotypes and wheel bodies made of different materials may lead to inaccuracies in the impresssion of such number wheels.

In order to compensate for such inaccuracies in dimensions, the known printing device provides a rule which is mounted in a movable carriage parallel to the motion direction, but is pivotable about a point at its end. A lever traces the rule and it is pivotable about a fixed point and adapted to transmit the pivotal movement as an additional positive or negative rotary motion to the gear driving the workpiece holder. This compensation device can be relatively exactly adjusted to the various diameters and longitudinal tolerances of the wheel bodies and stereotypes and efficiently used in a series manufacture which is relatively true to size. However, an automatic compensation of the diameter differences of the individual wheel bodies to be imprinted is not obtained. Another drawback is that with straight flat stereotypes, it is difficult to observe exactly the required division of the letters. In addition, such a correction device makes the printing unit substantially more expensive. Moreover, the handling and operation of such a device is thereby rendered more difficult.

SUMMARY OF THE INVENTION

The present invention provides a device for printing cylindrical objects which compensates automatically for any diameter variations of the objects at least within certain limits, and without a correctional device. In accordance with the invention, the stereotype printer includes a cylindrically arcuate surface which is mounted for rotation and is rotatably driven by a positive gear drive transmission in a fixed angular velocity speed ratio.

By ensuring that the workpiece is rotated and the segment is rotated and the printer is rotated from a common drive in a constant ratio of angular velocities, many advantages are obtained: During the printing operation, two synchronous rotary movements take place, having a constant ratio of angular velocities so that independently of the diameter tolerances, the beginning and the end of the impression on the circumference of the wheel body coincide. The diameter variations of the wheel bodies or workpieces resulting from the tolerances in manufacture are positively and uniformly compensated along the entire peripheral length of the body so that adjustment during the printing is not necessary. While in the manufacture of flat straight stereotypes, the division of the letters must in each case be calculated and plotted with the aid of a length-measuring instrument, a circular-arc stereotype has the advantage that the division can be adjusted during the engraving, with the necessary accuracy, and without any computation, by means of an angle dividing apparatus. In addition, by cylindrical grinding, the division can be subsequently brought to the desired size by reducing the effective diameter or radius of the letters. Thus, the inventive device offers substantially better conditions for observing the required dimensional tolerances both as to the manufacture of the stereotype and also as to the division of the imprinted workpiece.

To avoid an overprinting in the starting zone of the impression, it is advantageous to provide that the stereotype extend through an angle which is smaller than 360° and that the kinematic transmission ratio between the angular velocity of the shaft of the stereotype and the angular velocity of the workpiece holder corresponds to the ratio between the angle spanned by the stereotype and the angle of 360°. Thereby, a gap is formed between the two ends of the stereotype in which, after the effected impression, the workpiece holder and stereotype can be stopped without taking particular care of arriving at a certain exact starting point of impression on the wheel body. The starting point for the impression on the workpiece is thus always the same.

A particularly simple design favorable to the operation is obtained if the shaft of the stereotype is mounted in the upper part of a supporting bracket which is mounted in a fixed location on a base plate. The shaft is connected with a non-slip or positive gear transmission to a drive shaft which is mounted in the lower part of the supporting bracket. The drive shaft, in turn, is connected through a pair of gears to a further axially parallel and laterally offset transmission shaft on which a lever, carrying the workpiece holder at a level corresponding to that of the axis of rotation of the stereotype, is pivotally mounted and which is also kinematically connected to the workpiece holder.

While with the use of flat straight stereotypes, a rectangular relative movement between the stereotype and the workpiece holder must be executed both before, during and after each printing or hot impression operation, with the inventive device, it suffices in each case to perform a pivotal movement of the lever before and after the printing or hot impression operation. A substantially faster succession of operations can thereby be obtained, and substantially simpler bearing and actuating mechanisms can be used. In addition, the lever supporting the workpiece may be actuated hydraulically or pneumatically. Thus, a substantially more compact construction is also obtained.

Another advantageous feature of the invention is that a ribbon driving roller, along with a back-up roller, are both kinematically connected to the workpiece holder and to the transmission shaft along with receiving fixtures for the ribbon supply and take-up rollers which are mounted on the lever. This ensures that during the respective hot impression operation, the ink ribbon is advanced at a circumferential velocity of the wheel body, not only in synchronism, but without any slip. Thus, a sharp imprint of the individual letters is obtained and the entire advance of the ribbon always exactly corresponds to the needed length, since it commences and ends simultaneously with the printing or hot impression operation. It is necessary, of course, to adjust the circumferential velocity of the ribbon drive roller to the circumferential velocity of the wheel body to be imprinted.

In another advantageous development of the invention, the workpiece holder is driven off the transmission shaft through a gear belt which engages over a belt pulley of the ribbon drive roller. To heat the stereotype, an electric heating element is located in the shaft of the stereotype. For this purpose, the shaft is designed as a hollow shaft and it is driven directly by the common drive shaft through a gear belt.

Accordingly, it is an object of the invention to provide a printing device for printing cylindrical objects which includes a printing stereotype having a cylindrical arcuate printer surface which is rotatably mounted at a fixed location alongside a workpiece holder which is carried on a pivotal support lever which may be shifted so as to move the workpiece holder with the workpiece into and out of engagement with the printing surface of the printing stereotype and which also includes a positive gear drive connection to rotate the printing stereotype and the workpiece support with the workpiece and, preferably, also to drive a ribbon with an impression medium thereon which is disposed between the engageable surfaces of the workpiece and the printing surface.

A further object of the invention is to provide a printing device which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawing and descriptive matter in which there is illustrated a preferred embodiment of the invention.

DESCRIPTION OF THE PREFERRED EMBODIMENT

Figures 1, 2, 3:
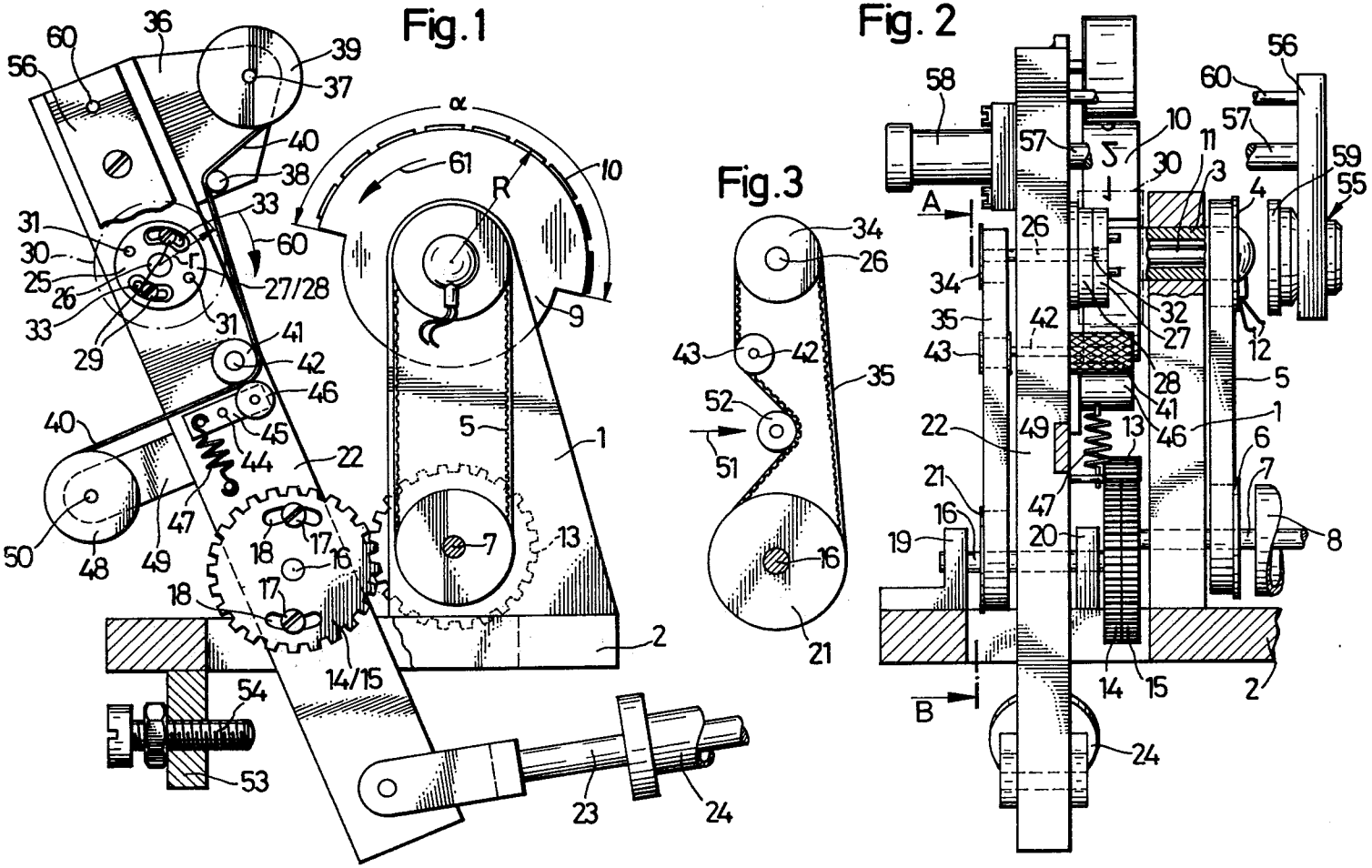
FIG. 1 is a side elevation view, partly in section, of a cylindrical article printer constructed in accordance with the invention.
FIG. 2 is an end elevational view of the device shown in FIG. 1, partly broken away.
FIG. 3 is a side elevational view of the workpiece holder and ribbon drive.

Referring to the drawing in particular, the invention embodied therein, comprises a printing device for printing cylindrical objects and particularly for printing numbers on wheels and it includes an upper supporting bracket 1 which is mounted on a base plate 2 and provides a first mounting means for rotatably supporting a hollow shaft 3 of a cylindrically curved stereotype printer or body of revolution 9 having a cylindrically arcuate printing surface 10. A geared pulley 4 is affixed to one end of hollow shaft 3 and it is in meshing engagement with a gear belt 5 which is driven from a drive shaft pulley 6 mounted on a drive shaft 8. Drive shaft 7 is an output shaft of a mechanically driven reduction gear 8. The stereotype printer body 9 is mounted at the opposite end of the hollow shaft 3 and it is preferably removably secured thereon so as to be rotatable with shaft 3. The printing impression or stereotype 10 extends through an angle $\alpha$ of 180°. The remaining half of the stereotype printer body 9 is recessed or radially offset inwardly. An electric heating element 11 is located within hollow shaft 3 and it has external electrical connections 12 which extend to the exterior side of the pulley 4.

The drive shaft 7 is rotatably mounted in the lower portion of the supporting bracket 1. A gear wheel 13 is affixed to shaft 7 and meshes with two gears 14 and 15 which are conjointly mounted on a transmission shaft 16 which is rotatably journaled in a moving member or lever arm 22. Lever arm 22 forms second mounting means for the rotational support of a shaft 26 of a workpiece holder 25. Gear 14 is mounted on shaft 16 for rotation therewith, and gear 15 is mounted on shaft 16 loosely and secured frontally to the gear 14 by means of screws 17. Screws 17 extend through oblong slots 18 of gear 15 and extend into tapholes of gear 14. Gears 14 and 15 have identical gearing which is constructed to eliminate the backlash between gears 13 and 14.

The transmission shaft 16 is rotatably mounted between two laterally spaced supports 19 and 20 which are mounted on base plate 2. A geared belt pulley 21 is mounted for rotation of shaft 16 along with support or lever 22. Lever 22 is a double-arm lever and it includes a lower arm which is connected to a piston rod 23 of a pneumatic cylinder 24 of a drive engine. An upper arm portion of lever 22 carries workpiece holder 25 at approximately the level of hollow shaft 3, so that stereotype printer body 9 may be engaged with a workpiece, such as a wheel body 30, held in the workpiece holder, when the support lever 22 is pivoted by the drive motor comprising cylinder 24 and piston rod 23.

Workpiece holder 25 comprises two disc-shaped parts 27 and 28 and part 28 is secured on shaft 26 against rotation. Disc 27 is frontally fixed to disc 28 by means of screws 29 so that it can be angularly positioned relative to disc 28 for accurate positioning of the workpiece 30 in a start location. In order to permit the fixing of workpiece 30, which is indicated in dash-dotted lines, disc 27 is equipped with centering pins 31. Locating marks 32 provided on the periphery of both of the discs 27 and 28 facilitate the angular adjustment of disc 27 relative to disc 28 and this is made possible by engagement of screws 29 in oblong slots 33.

A gear pulley 34 is carried on shaft 26 at the side opposite lever 22, and it is connected through a gear belt 35 to a gear pulley 21 mounted on transmission shaft 16.

A supporting arm 36 is secured to the outer end of lever 22, and faces toward stereotype printer 9, and it is provided with a journal pin 37 and a guide pin 38 for an inking tape or ribbon 40. Journal pin 37 carries a rotatable supply roller 39 for the ink ribbon 40 which is provided with a thermoplastic ink layer. Below workpiece holder 25, and axially parallel thereto, there is a drive roller 41 which is mounted on lever 22 and it is provided with a roughened or serrated surface to facilitate the driving feed thereof. Ribbon drive roller 41 is carried on a shaft 42 which is rotatably mounted in lever 22. Shaft 42 carries a gear pulley 43 on the end thereof which is opposite to the ribbon drive roller 41, and which is engaged with a gear belt 35 which runs over a gear belt 21 and a gear belt 34. A two-armed lever 45 is pivotally mounted on a journal pin 44 on lever 22 below ribbon drive roller 41. One arm of lever 45 carries a pressure roller 46. The other arm of lever 45 carries a tension spring 47 which is attached to pressure roller 46 in order to bias it against the surface of ribbon drive roller 41. An arm 49 carrying a shaft 50 is also mounted on the lever support 22, and a ribbon take-up roller 48 is fixed to shaft 50 for rotation therewith. Shaft 50 can be driven in the take-up direction by drive means (not shown) which, for example, may also comprise a gear belt drive. In order to ensure completely satisfactory engagement between gear belt 35 and pulleys 21, 34 and 43, the construction provides a spring-loaded idler 52, which is biased in the direction of arrow 51 and is pivotally mounted on lever 22. Guide pin 38 and ribbon drive roller 41 are disposed on arm 36 or on lever 22 so that ink ribbon 40 passes tangentially to wheel body 30 and between wheel body or workpiece 30 and stereotype printer surface 10.

A stop screw 54 is threadably engaged in a threaded bore of a flange 53 of base plate 2 and it may be adjustably positioned in order that its ends form an end stop for the pivotal movement of support lever 22. The adjustment is made so that wheel body or workpiece 30, which is to be imprinted, is moved in the operating position so that it applies against stereotype printing surface 10 under a desired pressure.

In order to hold workpiece 30 on workpiece holder 25 in its position, the apparatus includes a workpiece retainer 55 which is operated by a drive motor, such as, a pneumatically operated cylinder 58, having a piston rod 57 which engages a plate 56 containing a pressure disc 59 of workpiece retainer 55. The pressure disc 59 is rotatably mounted on the plate 56 coaxially of shaft 26 of workpiece holder 25. Plate 56 is guided by means of a guide rod 60 which is supported on lever support 22. In addition, workpiece holder 25 is advantageously provided with a pneumatic ejection device (not shown) in order to eject the workpiece after it has been printed.

Since in the embodiment of the invention the angle $\alpha$ defined throughout the range of the curvature of stereotype 10 is exactly 180°, and radius R of the stereotype is chosen as twice the radius $r$ of wheel body or workpiece 30 to be imprinted, workpiece 30 must be driven at a speed which is double the angular velocity of the speed of rotation of the stereotype surface 10. Consequently, the transmission ratio between the angular velocities of the body 9 or hollow shaft 3 and shaft 26 of workpiece holder 25 is the ratio of 1 : 2. This is why, in the present example, the transmission ratios, in respect to angular velocities, are 1 : 1 between drive shaft 7 and hollow shaft 3; 1 : 1 between driven shaft 7 and transmission shaft 16; and 1 : 2 between transmission shaft 16 and shaft 26 of workpiece holder 25. The transmission ratio between shaft 26 and ribbon drive roller 41 is chosen so that the circumferential velocity of ribbon drive roller 41 exactly corresponds to the circumferential velocity of workpiece 30 to be imprinted. Ribbon take-up roller 48 is driven by friction somewhat faster in order to have ink ribbon 40 permanently stretched during operation.

The control and operation of the device is very simple: In the swung-out position of lever 22, shown in FIG. 1, and in the extended position of workpiece retainer 55, the workpiece 30 to be imprinted, is fitted on workpiece holder 25. Then, by actuating a corresponding switch, workpiece retainer 55 is moved, with its rotary pressure disc 59, against the free front surface of workpiece 30. Thereupon, pneumatic cylinder 24 is actuated to pivot lever 22 clockwise, as shown in FIG. 1, in order to bring workpiece 30 into the printing position in which the lower arm of lever 22 applies against stop screw 54. Once the workpiece is in the printing position, the drive of drive shaft 7 is switched on, preferably by an electromagnetic clutch drive (not shown), so that the body of revolution 9, carrying stereotype surface 10 and workpiece holder 25 carrying workpiece 30, perform oppositely directed synchronous rotary motions in the direction of arrows 60 and 61, respectively. After more than half a turn performed by body 9, carrying stereotype surface 10, lever 22 is pivoted back into its initial position and workpiece retainer 55 is moved away from the imprinted wheel body or workpiece 30. Workpiece 30 is then ejected by a penumatic ejection device (not shown). After a complete turn, body 9, carrying stereotype 10, comes to a stop and so does workpiece holder 25, so that a new wheel body 30 can be fitted on. During the printing or hot impression operation, ink ribbon 40 is fed by ribbon drive roller 41 at the circumferential velocity of the stereotype 10 or of the wheel body or workpiece 30.

Due to the positive gear drive transmission connection between body of revolution 9 and workpiece holder 25 carrying the workpiece 30, it is ensured that the start and the end of the impression on the surface of the workpiece 30 will always coincide with each other and that, independently of any diameter variations to wheel body 30 within manufacturing tolerances, a uniform division of the impression of the wheel body 30 is securely obtained.

While a specific embodiment of the invention has been shown and described in detail to illustrate the application of the principles of the invention, it will be understood that the invention may be embodied otherwise without departing from such principles.

What is claimed is:

1. A printing device for printing cylindrical objects, such as wheels, drums, etc. comprising a printing stereotype having a cylindrical arcuate printer surface, first mounting means rotatably supporting said stereotype, a workpiece holder, second mounting means rotatably supporting said workpiece holder, movable support means movably supporting said second mounting means to move said workpiece holder toward and away from said printing stereotype for moving the workpiece into and out of engagement with the printer surface, means for applying ink to said printer surface, and positive gear drive means connected to rotate said stereotype and its printer surface and to rotate said workpiece holder at the same speeds but opposite directions of rotation and to hold said printer surface and said workpiece holder in the same relative angular positions during movement of said second mounting means for engagement and disengagement of the workpiece and said printing surface whereby engagement will always take place at a predetermined point on the cylindrical circumference of the workpiece and the surfaces of the workpiece and said printing stereotype will move smoothly together in contact during printing, said means for applying ink to said printer surface comprising an inking ribbon, means guiding said ribbon for movement between said workpiece and said printing surface, and inking ribbon drive means connected to said ribbon and to said positive gear drive means for rotation the ribbon in timed relationship to the rotation of the workpiece, said ribbon being disposed between said workpiece and said printer surface and being movable with said workpiece rotation and said printer surface rotation during printing of said workpiece, said positive gear drive means comprising a printing stereotype shaft having a driven gear pulley thereon, a drive shaft having a drive gear pulley thereon, a gear belt interconnecting said drive gear pulley to said driven pulley, said second support means comprising a pivotal support lever pivotally mounted adjacent said stereotype printer and comprising said movable support means carrying said workpiece holder, a transmission shaft rotatably supported on said lever and geared to said drive shaft, a transmission gear pulley affixed to said transmission shaft for rotation therewith, a workpiece pulley affixed to said workpiece shaft for rotation therewith, a workpiece drive gear belt engaged over said transmission shaft pulley and said workpiece shaft pulley to rotate said workpiece support, said workpiece support comprising a disc member, said disc member having means for adjustably angularly positioning a workpiece thereon, and means to shift said support lever for shifting the workpiece toward and away from said printing surface.

* * * * *